US008058597B2

(12) United States Patent
Geswender

(10) Patent No.: US 8,058,597 B2
(45) Date of Patent: Nov. 15, 2011

(54) LOW COST DEPLOYMENT SYSTEM AND METHOD FOR AIRBORNE OBJECT

(75) Inventor: Chris E. Geswender, Green Valley, AZ (US)

(73) Assignee: Raytheon Company, Waltham, MA (US)

( * ) Notice: Subject to any disclaimer, the term of this patent is extended or adjusted under 35 U.S.C. 154(b) by 338 days.

(21) Appl. No.: 12/436,567

(22) Filed: May 6, 2009

(65) Prior Publication Data

US 2010/0282895 A1 Nov. 11, 2010

(51) Int. Cl.
*F42B 10/00* (2006.01)

(52) U.S. Cl. ..... 244/3.29; 244/3.27

(58) Field of Classification Search ..... 244/3.24–3.29; 89/1.14

See application file for complete search history.

(56) References Cited

U.S. PATENT DOCUMENTS

| | | | | |
|---|---|---|---|---|
| 2,959,143 | A * | 11/1960 | Endrezze | 114/20.1 |
| 3,047,259 | A | 7/1962 | Tatnall et al. | |
| 3,978,790 | A | 9/1976 | Sandelius | |
| 4,607,810 | A * | 8/1986 | Frazer | 244/3.29 |
| 4,726,543 | A * | 2/1988 | Stessen | 244/3.1 |
| 4,752,052 | A * | 6/1988 | Galvin | 244/3.29 |
| 5,368,255 | A | 11/1994 | August | |
| 6,880,780 | B1 | 4/2005 | Perry et al. | |
| 7,004,425 | B2 * | 2/2006 | Okada et al. | 244/3.29 |
| 2007/0074636 | A1 * | 4/2007 | Rieger et al. | 102/378 |
| 2008/0111020 | A1 | 5/2008 | Peterson | |

OTHER PUBLICATIONS

International Searching Authority, European Patent Office, "International search Report," mailed Jul. 21, 2010; International Application No. PCT/US2010/032594, filed Apr. 27, 2010.

USPTO "Non-Final Office Action" mailed Jun. 9, 2011; U.S. Appl. No. 11/457,993, filed Jul. 17, 2006.

* cited by examiner

*Primary Examiner* — Timothy D Collins
*Assistant Examiner* — Jamie S Stehle
(74) *Attorney, Agent, or Firm* — Ingrassia Fisher & Lorenz, P.C.

(57) ABSTRACT

A deployment system is provided for utilization onboard an airborne object including a deployable element. In one embodiment, the deployment system includes a circumferential restraint and a release mechanism mounted to the airborne object. The circumferential restraint is disposed at least partially around the airborne object in a constraining position wherein the circumferential restraint prevents deployment of the deployable element. The release mechanism normally resides in a first position in which the release mechanism maintains the circumferential restraint in the constraining position. The release mechanism is movable to a second position to release the circumferential restraint from the constraining position and permit deployment of the deployable element.

12 Claims, 4 Drawing Sheets

LOW COST DEPLOYMENT SYSTEM AND METHOD FOR AIRBORNE OBJECT

TECHNICAL FIELD

The present invention relates generally to airborne deployment systems and, more particularly, to embodiments of a low cost deployment system and method suitable for operator "hand safe" use in conjunction with an airborne object, such as a projectile or missile.

BACKGROUND

Traditionally, canards and other deployable flight control surfaces have been primary utilized onboard larger airborne munitions, such as missiles. However, more recently, deployable canards have been utilized in conjunction with relatively small munitions, such as artillery shells and other projectiles. As a specific example, precision guidance kits (PGKs) have recently been developed that include a plurality of deployable canards. Each PGK is adapted to threadably mount to the nose of an artillery shell in place of a conventional fuse. In addition to providing a fusing function, the PGK guides the flight of the artillery shell by manipulating the position of the deployable canards in accordance with signals received from an onboard global positioning system (GPS) unit.

Deployable flight control surfaces of the type described above are typically maintained in a non-deployed position during launch or firing and subsequently released into a deployed position during flight. The deployable flight control surfaces are urged toward the deployed position by a structural biasing means (e.g., a spring) or by centrifugal forces, which act on the munition as it spins rapidly during flight. A deployment system carried by the airborne munition prevents deployment flight control surfaces until the desired time of deployment, which may occur shortly after munition launch or firing. By initially maintaining the flight control surfaces in a non-deployed or stowed position, the flight control surfaces are protected from physical damage that might otherwise in the course of soldier handling. In addition, by stowing the flight control surfaces during munition launch or firing, drag is reduced and the range of the munition is increased.

Conventional deployment systems utilized onboard larger airborne munitions, such as missiles, are generally reliable and robust. However, such conventional deployment systems tend to be undesirable bulky and costly for deployment aboard smaller airborne munitions, such as artillery shells and other projectiles. There thus exists an ongoing need to provide a deployment system suitable for utilization onboard airborne munitions (e.g., projectiles) and other airborne objects (e.g., satellites and sub-munitions) that is relatively compact and inexpensive to manufacture, in addition to being rugged and reliable. It is also desirable to provide a method for equipping an airborne object with such a deployment system. Other desirable features and characteristics of the present invention will become apparent from the subsequent Detailed Description and the appended Claims, taken in conjunction with the accompanying Drawings and this Background.

BRIEF SUMMARY

A deployment system is provided for utilization onboard an airborne object including a deployable element. In one embodiment, the deployment system includes a circumferential restraint and a release mechanism mounted to the airborne object. The circumferential restraint is disposed at least partially around the airborne object in a constraining position wherein the circumferential restraint prevents deployment of the deployable element. The release mechanism normally resides in a first position in which the release mechanism maintains the circumferential restraint in the constraining position. The release mechanism is movable to a second position to release the circumferential restraint from the constraining position and permit deployment of the deployable element.

A method is also provided for equipping an airborne object, which includes at least one deployable element, with a deployment system. In one embodiment, the method includes the steps of: (i) placing the deployable element in a non-deployed position, (ii) disposing a circumferential restraint around the airborne object in a constraining position wherein the circumferential restraint physically prevents deployment of the deployable element, and (iii) mounting a pin retraction mechanism to the body of the airborne object. The pin retraction mechanism normally resides in an extended position wherein the pin retraction mechanism engages the circumferential restrain to maintain the circumferential restraint in the constraining position. The pin retraction mechanism is movable to a retracted position wherein the pin mechanism releases the circumferential restraint from the constraining position and permits deployment of the deployable element.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
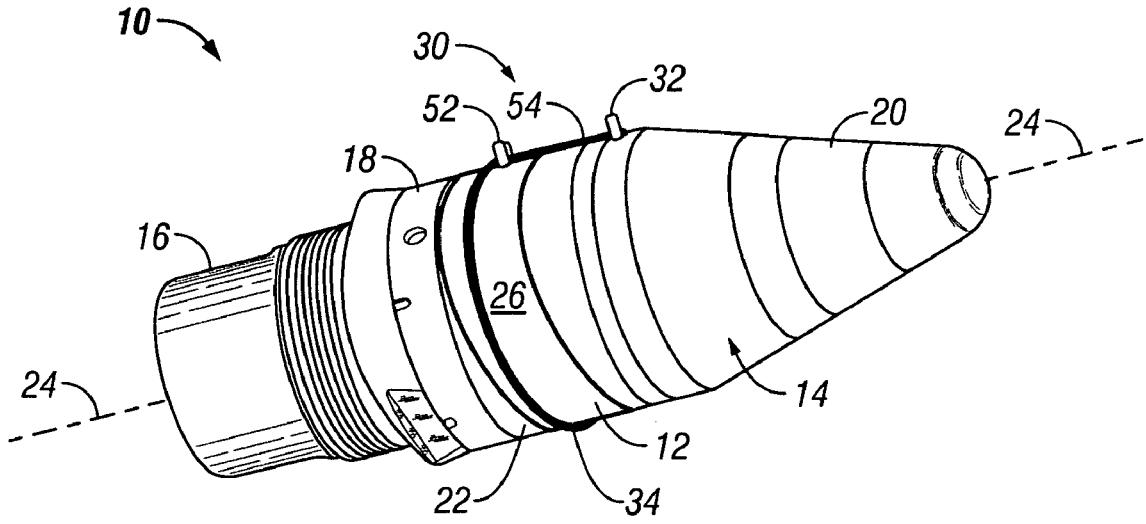
FIG. 1 is an isometric view of a precision guidance kit including a pair of canards maintained in a non-deployed position by a deployment system in accordance with a first exemplary embodiment.

FIG. 1 is an isometric view of a precision guidance kit ("PGK") 10 including a pair of deployable canards 12 in accordance with a first exemplary embodiment. PGK 10 includes a main body 14 having a threaded aft portion 16, an intermediate spindle 18, and a forward nose portion 20. A collar 22 is disposed around intermediate spindle 18 and is preferably machined to include one or more aerodynamic surfaces. Collar 22 is adapted to rotate relative to main body 14 about the longitudinal axis of PGK 10 (represented in FIG. 1 by dashed line 24). Canards 12 (only one of which is shown in FIG. 1) are mounted to collar 22 and may rotate along therewith. During operation of PGK 10, collar 22 and canards 12 rotate in a rotational direction opposite that of main body 14 such that the position of canards 12 is generally fixed in inertial space (commonly referred to as a "roll control fixed canard configuration") to increase guidance accuracy. Threaded aft portion 16 permits PGK 10 to be threadably mounted to the nose of an artillery shell or other projectile (not shown) in the place of a conventional fuse. In addition to providing a fusing function, PGK 10 also provides a precision guidance function by manipulating the position of canards 12, when deployed, in accordance with signals received from an onboard global positioning system (GPS) unit (also not shown) in the conventionally known manner.

Figure 2:
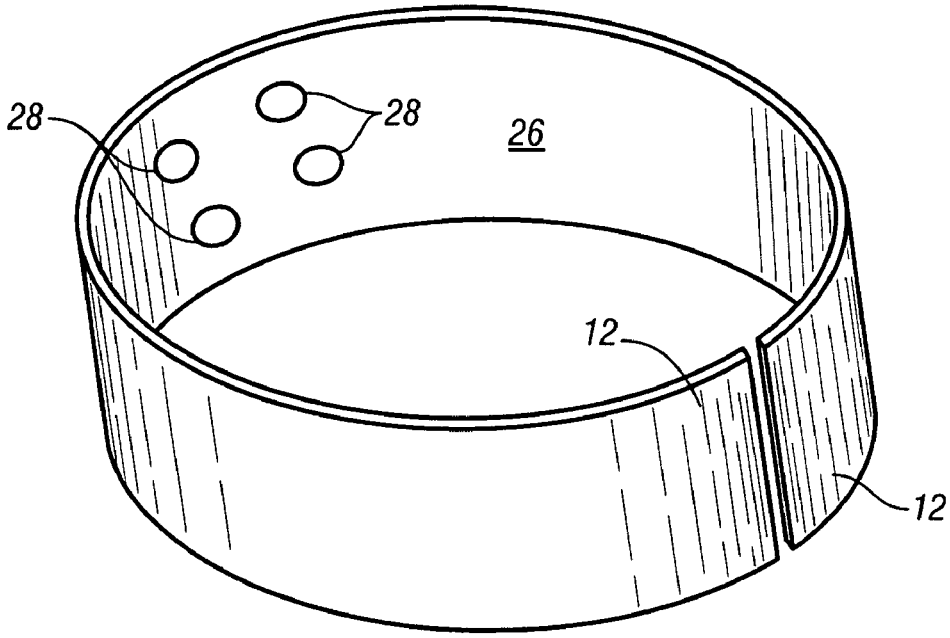
FIG. 2 is an isometric view of the canards included in the precision guidance kit shown in FIG. 1.

FIG. 2 is an isometric view of deployable canards 12 in a non-deployed or constraining position. In the exemplary embodiment shown in FIGS. 1 and 2, canards 12 are integrally formed as a single generally rectangular sheet 26, which may be machined from spring steel or another metal or alloy. As indicated in FIG. 2 at 28, a central portion of generally rectangular sheet 26 may be spot welded to collar 20 thus permitting the end portions of rectangular sheet 26 (i.e., canards 12) to expand radially outward into a deployed position. In the non-deployed position shown in FIGS. 1 and 2, canards 12 wrap circumferentially around collar 22 and, more generally, around main body 14 of PGK 10. During flight, PGK 10 spins about longitudinal axis 24 at a relatively high rate of revolution (e.g., 150 revolutions per second); canards 12 are consequently biased radially outward toward the deployed position by centrifugal forces during flight of PGK 10. To prevent the premature deployment of canards 12, PGK 10 is further equipped with a deployment system 30, which maintains canards 12 in a non-deployed position (FIGS. 1 and 2) until such time as it is desired to exploit the aerodynamic effects of canards 12.

In general, deployment system 30 includes two primary components: (i) a release mechanism, and (ii) a circumferential restraint. The release mechanism may comprise any device suitable for selectively releasing the circumferential restraint from a constraining position wherein the circumferential restraint maintains canards 12 in a non-deployed position as described more fully below. The release mechanism conveniently comprises a pin actuation mechanism and preferably comprises a "hand safe" explosively actuated pin retraction mechanism of the type described below. The circumferential restraint conveniently comprises at least one elongated flexible member, such as one or more wires, elastomeric cords, ropes, spring members, or the like. In a preferred group of embodiments, the circumferential restraint assumes the form of one or more retention cables as described more fully below in conjunction with FIGS. 3-6.

Figure 3:
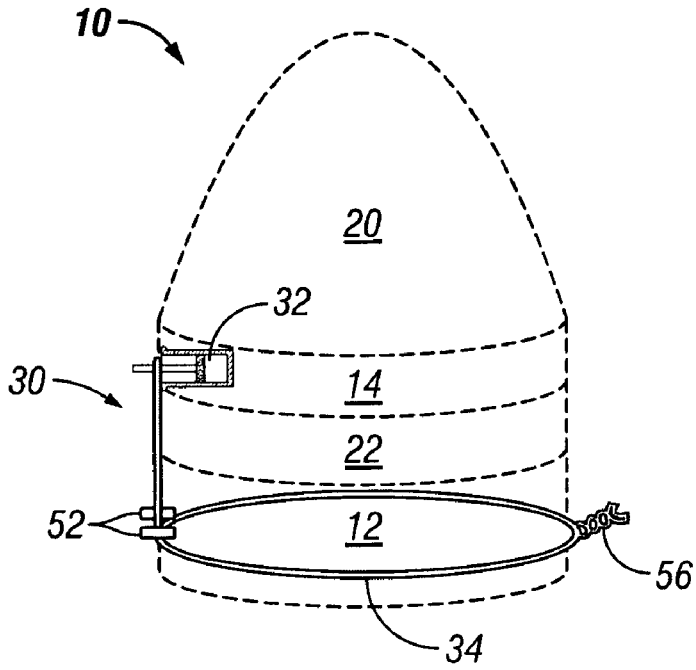
FIGS. 3 and 4 are generalized phantom views of the precision guidance kit shown in FIG. 1 in non-deployed and deployed positions, respectively.
Figure 4:
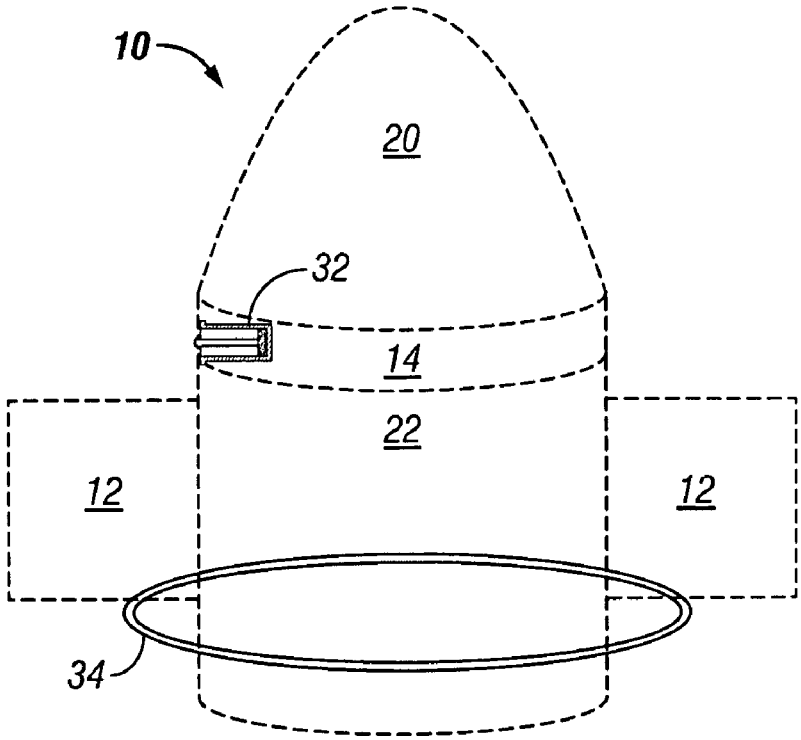

FIGS. 3 and 4 are a generalized phantom views of a forward portion of PGK 10 illustrating deployment system 30 prior to the release of canards 12 and immediately after the release of canards 12, respectively. In the illustrated example, deployment system 30 includes a "hand safe" explosively actuated ("EA") pin retraction mechanism 32 and a retention cable 34. Retention cable 34 normally resides in a constraining position (FIG. 3) wherein cable 34 extends around and radially engages canards 12. Stated differently, in the constraining position, retention cable 34 conformally engages an outer circumferential surface of PGK 10 and radially overlaps canards 12. When in the constraining position (FIG. 3), retention cable 34 is maintained in sufficient tension sufficient to prevent canards 12 from expanding radially outward into the deployed position shown in FIG. 4. To facilitate automated manufacture, the length of retention cable 34 is preferably greater than the length of the path that retention cable 34 follows in the constraining position. Retention cable 34 may be disposed around main body 14 of PGK 10 and positioned adjacent canards 12 such that cable 34 forms a loop, which loosely circumscribes PGK 10. The free ends of cable 34 may then be radially tightened around canards 12 by twist tightening as indicated in FIG. 3 at 56. If desired, twisted portion 56 of retention cable 34 may be spot welded to further help maintain radial tension within cable 34.

Figure 5:
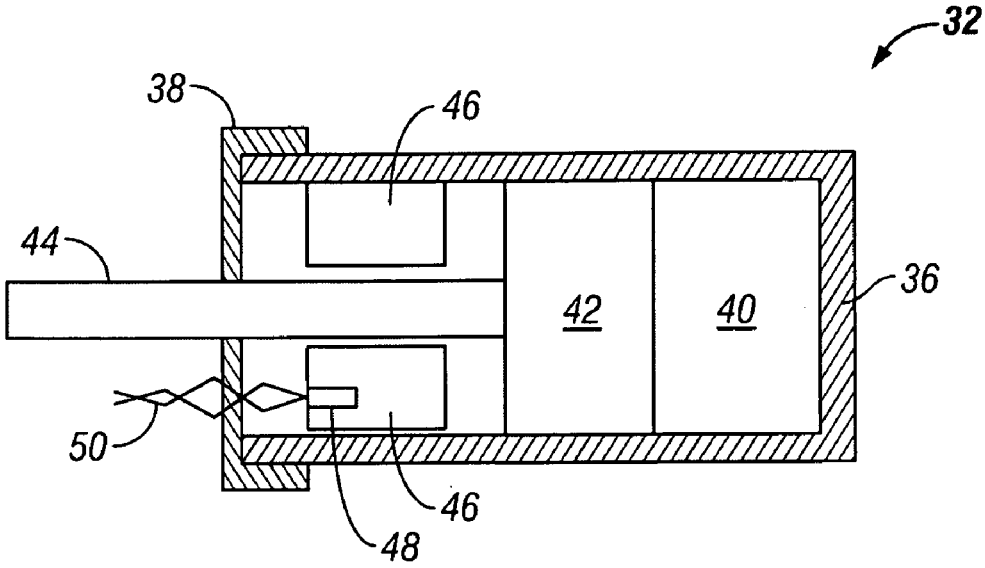
FIG. 5 is a generalized cross-sectional view of a release mechanism, in particular an explosively actuated pin retraction mechanism, included in the deployment system shown in FIGS. 1, 3, and 4.
Figure 6:
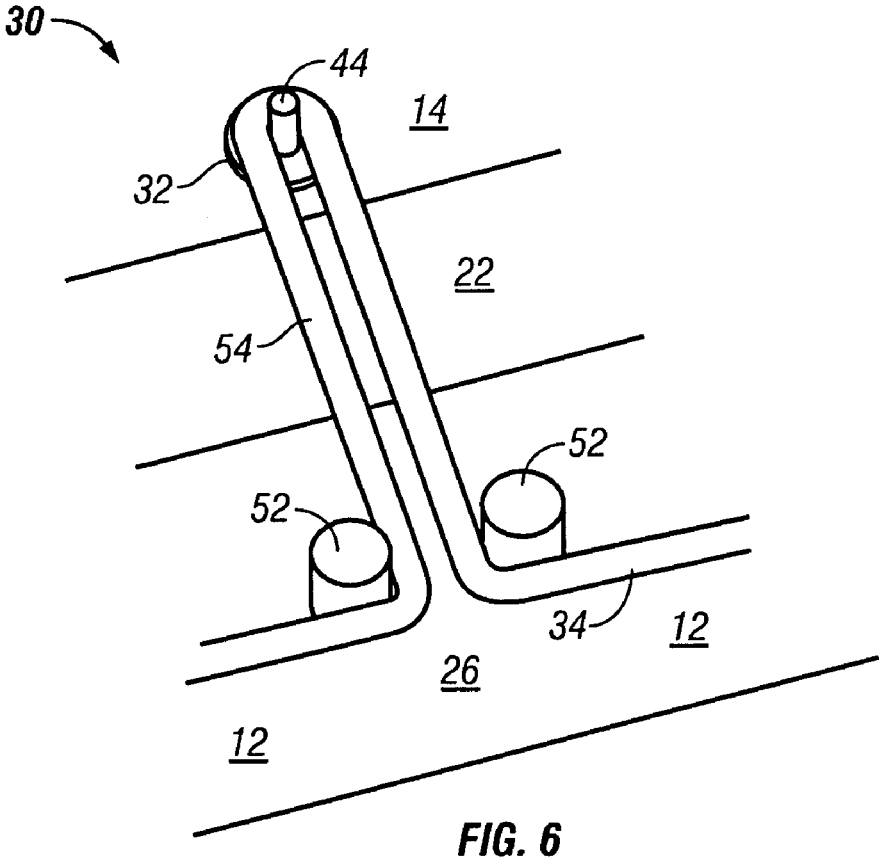
FIG. 6 is an isometric view of a portion of the precision guidance kit shown in FIGS. 1, 3, and 4 illustrating components of the exemplary deployment system in greater detail.

FIG. 5 is a generalized cross-sectional view of EA pin retraction mechanism 32 in an extended translational position. In this particular example, EA pin retraction mechanism 32 includes casing 36; an end cap 38, which is coupled to an end portion of casing 36 and which cooperates with casing 36 to define a cavity 40 within casing 36; a piston 42, which is slidably mounted within cavity 40; and a pin 44, which is fixedly joined to piston 42. In a preferred embodiment, piston 42 and pin 44 are formed as a single machined piece. An explosive material 46 is disposed within cavity 40 between end cap 38 and piston 42. A squib 48 embedded within explosive material 46 permits explosive material 46 to be detonated by a controller (not shown) electrically coupled to squib 48 via leads 50. Pin 44 of EA pin retraction mechanism 32 normally resides in an extended translational position. When explosive material 46 is detonated, the resulting forces act on the neighboring annular face of piston 42 and cause piston 42 to move rapidly away from end cap 38 (to the right in FIG. 5) and pin 44 to retract rapidly into casing 36.

In certain embodiments, deployment system 30 may further include one or more guide members that guide the circumferential restraint (e.g., retention cable 34) along a desired path. In the illustrated exemplary embodiment, deployment system 30 further includes first and second guide posts 52 (shown in FIG. 3), which project radially outward from main body 14 of PGK 10 proximate canards 12. More specifically, guide posts 52 are mounted to an intermediate portion of the generally rectangular sheet 26 defining canards 12. This may be more fully appreciated by referring to FIG. 6, which is an isometric view of deployment system 30 illustrating EA pin retraction mechanism 32, retention cable 34 (partially shown), and guide posts 52 in greater detail. Guide posts 52 axially align with each other and with canards 12, as taken along the longitudinal axis of PGK 10. As shown most clearly in FIG. 6, guide posts 52 cooperate with pin 44 of EA pin retraction mechanism 32 to guide a portion of cable 34 along a serpentine path 54. Guide posts 52 are fixed with collar 22 relative to EA pin retraction mechanism 32, which is fixedly mounted to main body 14 of PGK 10 and which is axially offset from guide posts 52, as taken along the longitudinal axis of PGK 10. As a result of this configuration, retention cable 34 not only prevents the premature deployment of canards 12, but also prevents premature rotation movement of collar 22 until cable 34 is released from its constraining position as described below. This example notwithstanding, guide posts 52 may be disposed at various other locations and may not be disposed on a rotatable collar in alternative embodiments.

At the desired time of deployment, pin 44 of EA pin retraction mechanism 32 is retracted via the detonation of explosive material 46 within casing 36 (FIG. 5). Upon retraction, pin 44 disengages from retention cable 34 and releases cable 34 from the constraining position shown in FIGS. 3 and 4. Retention cable 34 expands radially outward, disengages from canards 12, and slides aft of collar 22. Retention cable 34 may be jettisoned or may instead be retrained by an aft portion of the artillery shell to which PGK 10 is mounted and having an outer diameter greater than that of PGK 10. No longer constrained by retention cable 34, canards 12 are permitted to expand radially into the deployed position as generally shown in FIG. 4. With canards 12 in the deployed position, PGK 10 may provide precision guidance to its host artillery shell by manipulating the position of canards 12 in the previously described manner.

The foregoing has thus provided an exemplary embodiment of a deployment system suitable for use onboard an airborne object. In addition to being reliable and robust, the above-described exemplary deployment system is also relatively lightweight, compact, and inexpensive to produce. As a result, the above-described deployment system is especially well-suited for deployment aboard a smaller airborne munition, such as an artillery shell. As an additional advantage, embodiments of the deployment system are amenable to fully automated manufacturing processes. For example, in the above-described exemplary embodiment, the provision of guide posts 52 (FIGS. 3 and 6) in addition to pin retraction mechanism 32 (FIGS. 1 and 3-6) permit an automated machine to readily wrap retention cable 34 (FIGS. 1, 3, 4, and 6) around main body 14 of PGK 10 (FIGS. 1, 3, 4, and 6) and subsequently bring cable 34 into a sufficient tension via twist tying as described above in conjunction with FIG. 3.

Figure 7:
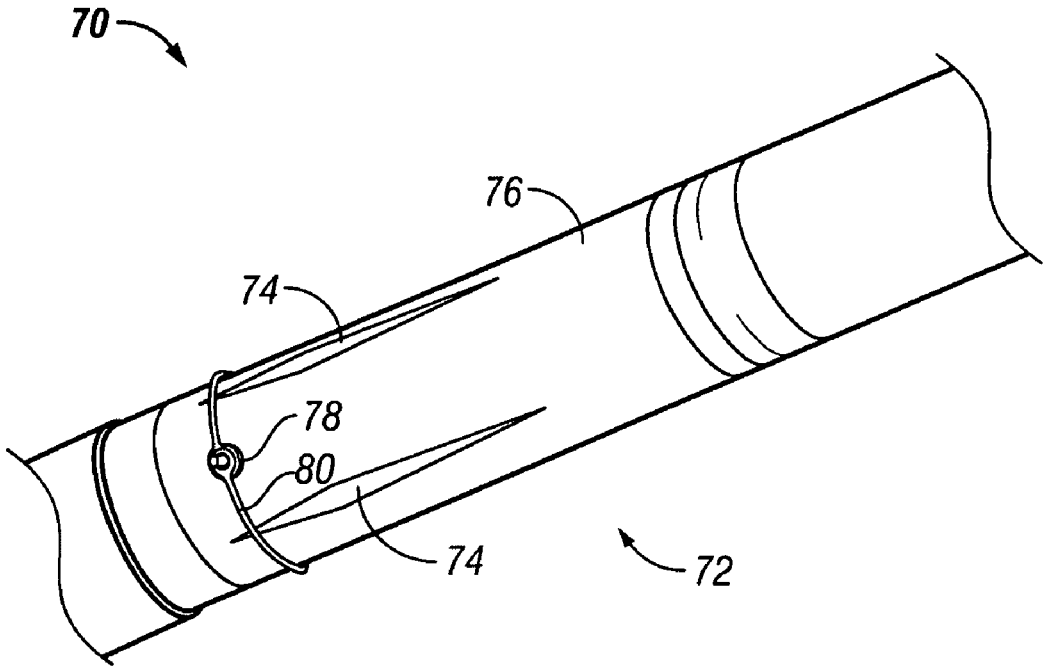
FIG. 7 is a isometric view of a generalized missile (partially shown) including a plurality of canards maintained in a non-deployed position by a deployment system in accordance with a second exemplary embodiment.
Figure 8:
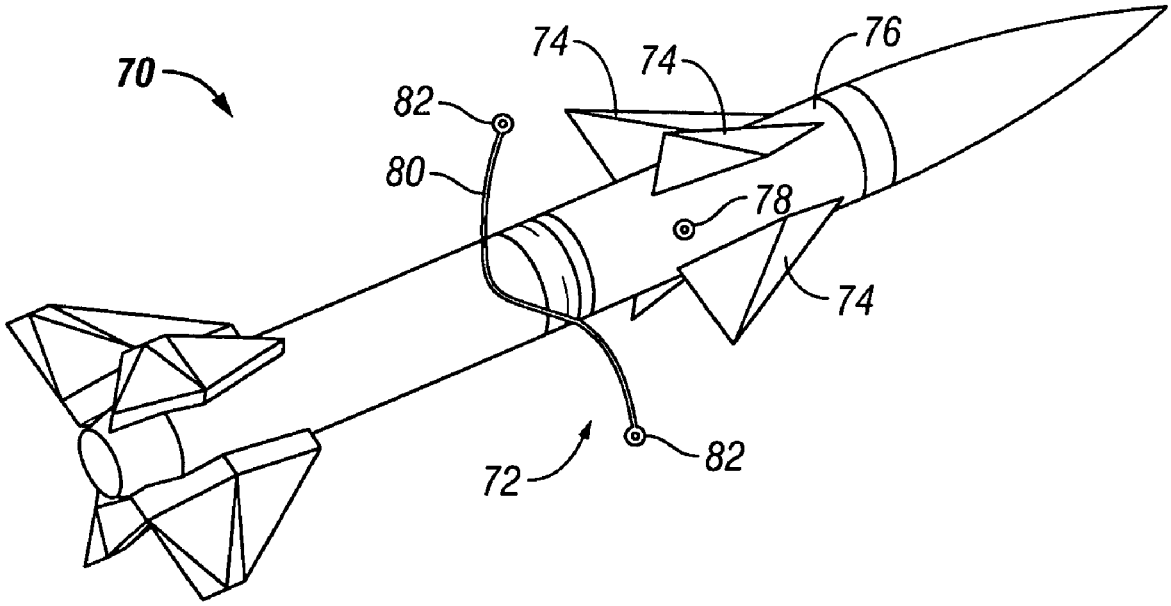
FIG. 8 is an isometric view of the generalized missile shown in FIG. 7 illustrating the deployment of the canards.

In the above-described exemplary embodiment, deployment system 30 included first and second guide posts 52 (FIGS. 3 and 6), which were axially offset from guide posts 52 such that retention cable 34 followed a serpentine path in the constraining position preventing both the deployment of canards 12 and rotation of collar 22. This example notwithstanding, in alternative embodiments, the deployment system may not include guide posts and the circumferential restraint may follow paths having other geometries. Further emphasizing this point, FIGS. 7 and 8 are isometric views of a generalized missile 70 (partially shown in FIG. 7) equipped with a deployment system 72 in non-deployed and deployed positions, respectively, in accordance with a second exemplary embodiment. In this example, missile 70 includes four canards 74, which are pivotally joined to an intermediate section 76 of missile 70. Canards 74 are biased toward the deployed position shown in FIG. 8. Deployment system 72 physically prevents the deployment of canards 74 until the desired time of deployment. In many respects, deployment system 72 is similar to deployment system 30 described above in conjunction with FIGS. 1-6. For example, deployment system 72 includes a pin retraction mechanism 78 and a retention cable 80, which follows an annular path around intermediate section 76 in the constraining position. In contrast to cable 34 of deployment system 30, the ends of retention cable 80 terminate in first and second eyelets 82 (identified in FIG. 8). Prior to deployment of canards 74, the pin of pin retraction mechanism 78 extends through eyelets 82 to maintain retention cable 80 in the constraining position shown in FIG. 7. Pin retraction mechanism 78 is generally axially aligned with canards 74, as taken along the longitudinal axis of missile 70. When pin retraction mechanism 78 is actuated, the pin of pin retraction mechanism 78 disengages from eyelets 82 of retention cable 80 thereby releasing cable 80 from its constraining position (FIG. 7) and permitting canards 74 to pivot into the deployed position shown in FIG. 8.

The has thus been provided multiple exemplary embodiments of a deployment system for utilization aboard an airborne object, such as a projectile, that is reliable, compact, relatively inexpensive to produce, and amenable to automated manufacture. Although, in the above-described exemplary embodiments, the deployment system was utilized to maintain one or more canards in a deployed position until such time as it is desired to release the canards to a deployed position, the deployment system may be utilized to selectively deploy various other types of deployable elements, such as other types of flight control surfaces, antennae, solar collectors, landing gears, and other deployable features. Furthermore, although the foregoing has described a first exemplary embodiment of the deployment system in the context of a precision guidance kit adapted threadably mounted to an artillery shell and a second exemplary embodiment of the deployment system in the context of a generalized missile, it will be appreciated that embodiments of the deployment system are equally suitable for utilization onboard a wide variety of airborne objects, including other types of airborne munitions (e.g., unmanned air vehicles), airborne sub-munitions, modular components adapted to be mounted to airborne munitions (e.g., fuse kits), satellite, land or water based robotic vehicles, and certain aircraft. It is noted, however, that embodiments of the deployment system are compact and relatively inexpensive to manufacture and are consequently especially well-suited for deployment aboard smaller sized airborne munitions, such as artillery shells and other projectiles.

The foregoing has also provided an exemplary method for equipping an airborne object, such as a projectile or other airborne munition, including at least one deployable element, such as a canard or other flight control surface, with a deployment system. In general, the exemplary method includes the steps of: (i) placing the deployable element in a non-deployed position; (ii) disposing a circumferential restraint (e.g., a retention cable) around the airborne object in a constraining position wherein the circumferential restraint physically prevents deployment of the deployable element; and (iii) mounting a pin retraction mechanism (e.g., an explosively actuated pin retraction mechanism) to the body of the airborne object. The pin retraction mechanism normally resides in an extended position wherein the pin retraction mechanism engages the circumferential restrain to maintain the circumferential restraint in the constraining position. The pin retraction mechanism is movable to a retracted position wherein the pin mechanism releases the circumferential restraint from the constraining position and permits deployment of the deployable element. In certain embodiments, the method further includes the step of forming a guide post projecting from the airborne object at a location substantially axially aligned with the deployable element and axially offset from the pin retraction mechanism. When provided, the guide post engages the circumferential restraint to guide a portion of the circumferential restraint along a serpentine path.

While multiple exemplary embodiments have been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A deployment system for utilization onboard an airborne object including a deployable element, the deployment system comprising:

a circumferential restraint disposed at least partially around the airborne object in a constraining position wherein the circumferential restraint prevents deployment of the deployable element, a portion of the circumferential restraint following a serpentine path in the constraining position;

a pin actuation mechanism, comprising:

a casing mounted to the airborne object; and a pin slidably mounted to the casing, the pin normally residing in an extended position wherein the pin engages the circumferential restraint to maintain the circumferential restraint in the constraining position, the pin movable to a retracted position to release the circumferential restraint from the constraining position and permit deployment of the deployable element; and a guide member mounted to the airborne object, the guide member engaging the circumferential restraint in the constraining position to help guide the circumferential restraint along the serpentine path.

2. A deployment system according to claim 1 wherein the circumferential restraint comprises at least one elongated flexible member.

3. A deployment system according to claim 2 wherein at least one elongated flexible member conformally engages an outer circumferential surface of the airborne object in the constraining position to physically prevent the radial expansion of the deployable element.

4. A deployment system according to claim 2 wherein the elongated flexible member comprises a twisted segment, the twisted segment generally maintaining the elongated flexible member in radial tension with the airborne object when the elongated flexible member is in the constraining position.

5. A deployment system according to claim 1 wherein the circumferential restraint comprises an eyelet through which the pin extends when the circumferential restraint is in the constraining position.

6. A deployment system according to claim 5 wherein the pin actuation mechanism is substantially axially aligned with the deployable element, as taken along the longitudinal axis of the airborne object.

7. A deployment system according to claim 1 wherein the guide member comprises a guide post projecting radially from the airborne object.

8. A deployment system according to claim 7 wherein the pin actuation mechanism is axially spaced apart from the guide post, as taken along the longitudinal axis of the airborne object.

9. A deployment system according to claim 8 wherein the airborne object includes a main body having a collar rotatably mounted thereto, and wherein the release mechanism is fixedly coupled to the main body, the circumferential restraint generally preventing the rotation of the collar when the circumferential restraint is in the constraining position.

10. A deployment system for utilization onboard an airborne object comprising a body and a rotor collar disposed around the body and configured to rotate relative thereto, the deployment system comprising:

a canard mounted to the rotor collar;

an elongated flexible restraint circumferentially disposed around a first section of the airborne object and normally residing in a constraining position wherein the elongated flexible restraint prevents deployment of the canard and rotation of the rotor collar; and a pin actuation mechanism, comprising:

a casing mounted to the airborne object; and a pin slidably mounted to the casing, the pin normally residing in a first translational position wherein the pin engages the elongated flexible restraint to maintain the elongated flexible restraint in the constraining position, the pin movable to a second translational position to release the elongated flexible restraint from the constraining position and permit deployment of the canard;

wherein the elongated flexible restraint comprises a retention cable twist-tightened around the canard and the rotor collar.

11. A deployment system according to claim 10 wherein the pin actuation mechanism comprises an explosively actuated pin retraction mechanism.

12. A method for equipping an airborne object with a deployment system, the airborne object including at least one deployable element, the method comprising the steps of:

placing the deployable element in a non-deployed position;

disposing a circumferential restraint around the airborne object in a constraining position wherein the circumferential restraint physically prevents deployment of the deployable element;

mounting a pin retraction mechanism to the body of the airborne object, the pin retraction mechanism normally residing in an extended position wherein the pin retraction mechanism engages the circumferential restrain to maintain the circumferential restraint in the constraining position, the pin mechanism movable to a retracted position wherein the pin retraction mechanism releases the circumferential restraint from the constraining position and permits deployment of the deployable element; and forming a guide post projecting from the airborne object at a location substantially axially aligned with the deployable element and axially offset from the pin retraction mechanism, the guide post engaging the circumferential restraint to guide a portion of the circumferential restraint along a serpentine path.

* * * * *